US009333793B2

(12) United States Patent
Frech et al.

(10) Patent No.: US 9,333,793 B2
(45) Date of Patent: May 10, 2016

(54) PHOTO BOOK AND METHOD FOR PRODUCING THE SAME

(75) Inventors: Michael Frech, Wendlingen (DE); Thomas Fischer, Nuertingen (DE)

(73) Assignee: ONPICS GMBH, Nuertingen (DE)

( * ) Notice: Subject to any disclaimer, the term of this patent is extended or adjusted under 35 U.S.C. 154(b) by 334 days.

(21) Appl. No.: 13/995,080

(22) PCT Filed: Dec. 5, 2011

(86) PCT No.: PCT/EP2011/071718

§ 371 (c)(1),
(2), (4) Date: Jun. 17, 2013

(87) PCT Pub. No.: WO2012/080013

PCT Pub. Date: Jun. 21, 2012

(65) Prior Publication Data

US 2013/0264812 A1 Oct. 10, 2013

(30) Foreign Application Priority Data

Dec. 17, 2010 (DE) ..... 20 2010 016 716 U

(51) Int. Cl.
*B42D 3/12* (2006.01)
*B42D 1/08* (2006.01)
*B42C 11/00* (2006.01)

(52) U.S. Cl.
CPC . *B42D 3/12* (2013.01); *B42C 11/00* (2013.01); *B42D 1/08* (2013.01); *B42D 3/123* (2013.01)

(58) Field of Classification Search
CPC ..... B42D 3/12; B42D 3/123
USPC ..... 412/3, 17
See application file for complete search history.

(56) References Cited

U.S. PATENT DOCUMENTS

| | | | | |
|---|---|---|---|---|
| 1,495,467 | A * | 5/1924 | White | 281/37 |
| 5,374,195 | A * | 12/1994 | McClanahan | 434/317 |
| 8,072,330 | B1 * | 12/2011 | Nichols, Sr. | 340/572.1 |
| 2004/0208685 | A1 * | 10/2004 | Peters, Jr. | 402/73 |
| 2006/0261592 | A1 * | 11/2006 | O'Keefe | 281/22 |
| 2009/0211126 | A1 * | 8/2009 | Oh | 40/124.03 |
| 2010/0026915 | A1 * | 2/2010 | Pozin et al. | 348/838 |
| 2010/0164836 | A1 * | 7/2010 | Liberatore | 345/1.1 |
| 2013/0316321 | A1 * | 11/2013 | Herz | 434/317 |

FOREIGN PATENT DOCUMENTS

| | | |
|---|---|---|
| DE | 202009017420 U1 | 7/2010 |
| DE | 102009049593 | 5/2011 |
| WO | WO-2007/085661 A1 | 8/2007 |

OTHER PUBLICATIONS

International Search Report of PCT/EP2011/071718 Mailed Mar. 3, 2012 With an English Translation.

* cited by examiner

*Primary Examiner* — Kyle Grabowski
(74) *Attorney, Agent, or Firm* — FisherBroyles, LLP; Robert Kinberg

(57) ABSTRACT

A photo book includes a cover and a structural unit integrated with the cover. The structural unit includes an electronic memory element and a connection element connected to the memory element. The cover includes a body element and a flexible sheath surrounding the body element. The body element has a peripheral edge and a through passage that opens out along the peripheral edge of the body element. The structural unit is insertable into the through-passage so that the connection element opens out along a peripheral edge of the cover.

14 Claims, 4 Drawing Sheets

PHOTO BOOK AND METHOD FOR PRODUCING THE SAME

CROSS-REFERENCE TO RELATED APPLICATIONS

This application is a U.S. National Stage Application of International Application No. PCT/EP2011/071718, filed Dec. 5, 2011, claiming priority to Application No. DE 2020 010016716.7 filed in German on Dec. 17, 2010.

BACKGROUND OF THE INVENTION

The invention relates to a photo book as well as to a method for producing the same.

A photo book of this type is already disclosed in German patent document DE 10 2009 049 593.

The known photo book comprises a cover with therein integrated electronic memory element and thereto connected connection element. The connection element opens out along one peripheral edge of the cover and can be connected to external connection means for reading data into the memory element as well as for reading data out of the memory element.

The photo book thus has a considerably expanded functionality as compared to traditional photo books since it contains not only printed information, but also offers the option of electronic storage of data. For this, the stored data are preferably assigned to the printed information. In particular, the stored data comprise photographs and/or image sequences, meaning film sequences, which are thematically assigned to the printed information.

With this photo book, a central archiving of electronic data is made possible in addition to the image display on the pages of the photo book, wherein the data volume can be changed flexibly at any time through the input or deleting of data in the memory element. The data can furthermore also be read out for use at any time.

SUMMARY OF THE INVENTION

It is an object of the invention to further improve the functionality of a photo book of the aforementioned type.

The photo book according to the invention, which is provided with a cover, comprises an electronic memory element and a thereto-connected connection element. The cover comprises body elements which are surrounded by a flexible sheath, wherein a body element is provided with a through-passage that opens out along one of its peripheral edges. The electronic memory element and the connection element together form a structural unit, wherein the structural unit is inserted into the through-passage in such a way that the connection element opens out along the peripheral edge of the cover.

The method according to the invention relates to producing a photo book with a cover, into which an electronic memory element and thereto connected connection element are integrated and which comprises a flexible sheath and at least one body element. The method is characterized by steps, including:

inserting a structural unit comprising the electronic memory element and the connection element into a through-passage of a body element which opens out along one of the peripheral edges of the body element, wherein the connection element is exposed along the peripheral edge of the body element; and joining and enclosing the body element with the flexible sheath so that a cutout exists for the connection element.

The embodiment of the electronic memory element and the connection element as a single structural unit represents an advantage of the invention. The electronic memory element and the connection element thus form a component which can be inserted during a single operational step into the through-passage of the body element and can be secured therein.

The integration of these electronic components into the cover can thus occur quickly and with little structural expenditure.

Owing to the design of the receptacle for the structural unit in the form of a through-passage in the body element of the cover, the complete thickness of the body element can be utilized to accommodate the structural unit. That is to say, the height of the component can correspond to the thickness of the body element, so that even structural units with relatively large structural heights can be integrated into the cover, without forming undesirable bulges in the cover.

A further advantage lies in the geometry and arrangement of the through-passage along the peripheral edge of the body element. With the integration of the structural unit in the through-passage, the unit is already oriented so that the connection element in its desired position along the peripheral edge of the body element, thus also the edge of the cover, is accessible and can therefore be connected without further adaptation to external connection means.

An additional advantage is that with the integration of the structural unit into the through-passage, this structural unit is already secured in the body element, so that these elements subsequently form a stable unit. No additional layers which are composed in the same way as the body element of stable, non-flexural materials therefore need to be affixed to the top or bottom of the body element in order to hold the structural unit inside the through-passage of the body element. Rather, the structural unit inserted into the through-passage already forms a stable unit together with the surrounding body elements.

The contour of the through-passage in the body element is adapted to the outside contour of the structural unit, such that the structural unit fits form-fittingly along the peripheral edges of the through-passage once it is inserted and is thus already joined relatively tightly with the body element.

The hold between the structural unit and the body element is advantageously increased further in that the structural unit can be inserted into the through-passage and can be affixed with adhesive along the peripheral edges of the body element which delimit the through-passage.

Once the structural unit is inserted into the through-passage, it is then fixedly connected with the adhesive agents to the body element.

The body element which is resistant to bending and preferably is composed of cardboard, paper board or plastic thus forms a stable structural unit.

According to an alternative embodiment of the invention, the body element is an injection-molded plastic part which is produced in a mold. For this, the structural unit serves as a part that is inserted into the mold and is then surrounded with plastic molding compound during the production of the body element.

This embodiment is distinguished by a particularly economic production process. Not only is the body element produced in a single injection-molding step, but the structural unit is simultaneously integrated into the through-passage which, in the present case, is obtained by the process of injection-molding with plastic around the structural unit. It is particularly advantageous that owing to the injection-molding around the plastic part which forms the body element, the plastic part is fixedly connected to the structural unit, so that no further means must be provided for securing the structural unit to the body element.

The structural may comprise a board with thereon arranged memory chip, which forms the electronic memory element with thereto connected connection element, wherein in particular a casting compound may be applied to the board.

The board may function as a support for the electronic memory element in the form of a memory chip as well as for the connection element, thereby providing the structural unit with high inherent stability. This inherent stability may be further increased by applying the casting compound, wherein this compound furthermore protects the electronic components of the unit against mechanical damages. Applying the casting compound furthermore achieves an adaptation of the geometry of the structural unit to the body element in that the layer thickness for the casting compound is selected such that the structural height of the unit matches the thickness of the body element.

According to a first embodiment of the invention, the connection element can be used to establish contact with external connecting means.

For this, the connection element may be embodied as a connector, in particular a mini USB connector or a magnetically adhering connector.

Alternatively, the connection element may be a wirelessly operating communication module.

The communication module may be a WLAN module or a Bluetooth module.

The structural unit with the electronic memory element and the connection element may be integrated into the photo book so that the scope of the production process for producing the photo book is not increased noticeably.

The structural unit may be integrated in a single operational step into the body element. All further production steps for producing the photo book are not influenced despite the additionally provided structural unit.

As soon as the structural unit is integrated into the body element, the cover for the photo book may be produced by placing the body elements in the desired positions onto the flexible cover and, if applicable, affixing the body elements thereon with adhesive agents. The flexible sheath, which may consist of an easily bendable material such as paper, a plastic film or the like, may be folded around the peripheral edges of the body elements and secured on the inside areas of the body elements.

According to an embodiment, a recess delimited by a reinforcing layer may be provided in the flexible sheath, so as to form an opening out for the connection element.

According to an embodiment of the invention, the reinforcing layer can be applied easily and cheaply by incorporating this step it into the production process for the photo book. At the start of the production process, the body elements may rest on the sheath which is spread out flat and are affixed thereto with adhesive or the like. Before the cover is formed through folding and placing the sheath underneath, the opening in the form of a hole is worked at the desired location into the sheath, wherein this opening forms the cutout for the connection element in the completed cover. The reinforcing layer is then applied to the edge of the sheath which delimits the opening. In the simplest case, the reinforcing layer is applied only to the outside of the sheath. To ensure an even higher strength and resistance for the edge of the sheath which delimits the cutout, a reinforcing layer can be applied to the outside as well as the inside of the sheath.

The reinforcing layer on the cover, provided according to the invention, functions to reinforce and stabilize the cover, so that it does not tear or is damaged during a mechanical contacting. Adverse effects for the cover are consequently avoided, even in cases where a frequent contacting of the connection element takes place.

The reinforcing layer is generally composed of a tear-resistant material, in particular a plastic material. It is particularly advantageous if the reinforcing layer is embodied as an adhesive film or foil, so that it can be affixed quickly and easily to the cover.

Owing to the positioning of the cutout (opening), relative to the position of the connection element, it is achieved that during the subsequent folding of the flexible sheath, the connection element in the cutout is exposed and can thus be brought into contact with an external connecting means.

The photo book is generally created with the aid of a Software program that functions to generate a print template for the photo book to be printed. A client who wants to produce a photo book supplies the corresponding image data which are integrated into the print template and are provided with texts. When making available the image data, the client defines which image data are to appear in the printed form in the photo book and which data are to be stored in the memory element. The Software then operates so that parallel to generating the print template, the respectively specified data are read into the memory element. The process of entering of the data into the memory element is therefore completely integrated into the operation of generating the print template for the photo book. The Software in general can represent a part of a client-server architecture where the data input takes place offline, e.g. via CD or DVD. Alternatively, the data input can also take place online via a web server on the Internet.

The photo book according to the invention preferably contains photographs printed on its pages. However, the user of the photo book typically has more photographs than are printed in the photo book or also associated films. As a result of having the option to store all the additional data in the photo book itself, it is possible to omit otherwise required, separate storage media such as a computer, DVD, CD, mobile telephone or the like. The availability and ability to retrieve the data can thus be increased significantly.

The photo book according to a different variant may be used solely as an index book for data stored in the memory element. In that case, the photo book may only contain indexing as printed information, meaning cataloging of the data, preferably photographs or films which are stored in the memory element.

The connection element of the photo book can be connected to external connection means for reading data out of the electronic memory element and for the wireless transfer of these data to a display unit, such as a PC, where the data can be directly visualized, meaning displayed. The functionality of the photo book is thus expanded considerably as a result of this connection option.

An electronic capture of pages is provided according to another advantageous embodiment, which permits the selective reading out of a portion of the data stored in the memory element in dependence on the electronically captured, currently opened page.

As a result, an especially user-friendly access is provided to specific partial data volumes stored in the memory element. This type of embodiment can be used quite advantageously in connection with the communication module. In that case, the partial content of the memory element can be read out via the communication module simply by opening a desired page and can be displayed directly on a display unit.

BRIEF DESCRIPTION OF THE DRAWINGS

The invention is explained in the following with the aid of the drawings which show in.

DETAILED DESCRIPTION OF THE INVENTION

Figure 1:
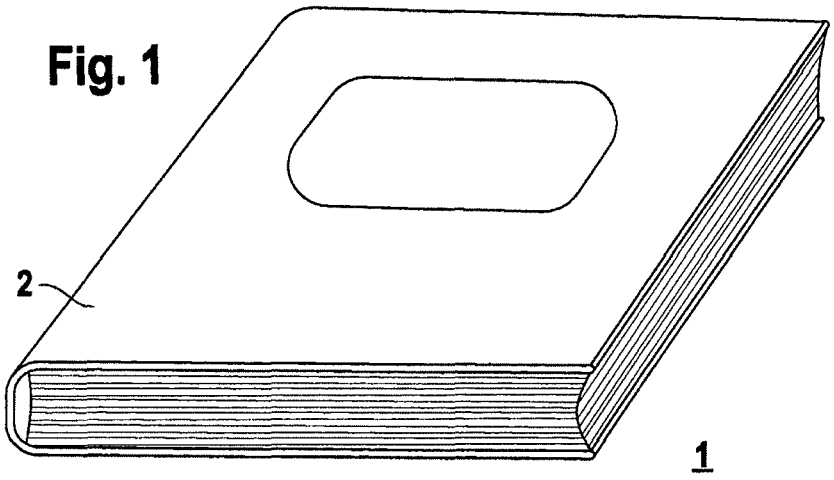
FIG. 1 is a schematic representation of a photo book.

FIG. 1 schematically shows an embodiment of a photo book 1. The photo book 1 is produced with the aid of software, which can be a component of a client-server computer system. Image data of photographs, which are made available offline via data carriers such as CD or DVD, are used in that case to generate a print template for the photo book 1. Alternatively, the software can also be a component of a web service, so that the image data can be made available online. The photo book 1 produced in this way furthermore comprises pages with photographs. The photo book 1 also comprises a cover 2 in which the pages are fixedly arranged. In principle, the photo book 1 can also take the form of a ring binder.

FIGS. 2 to 6 show individual components of the photo book 1 according to FIG. 1 and furthermore illustrate a process for producing the photo book 1, in particular its cover 2, according to an embodiment of the invention.

Figure 2:
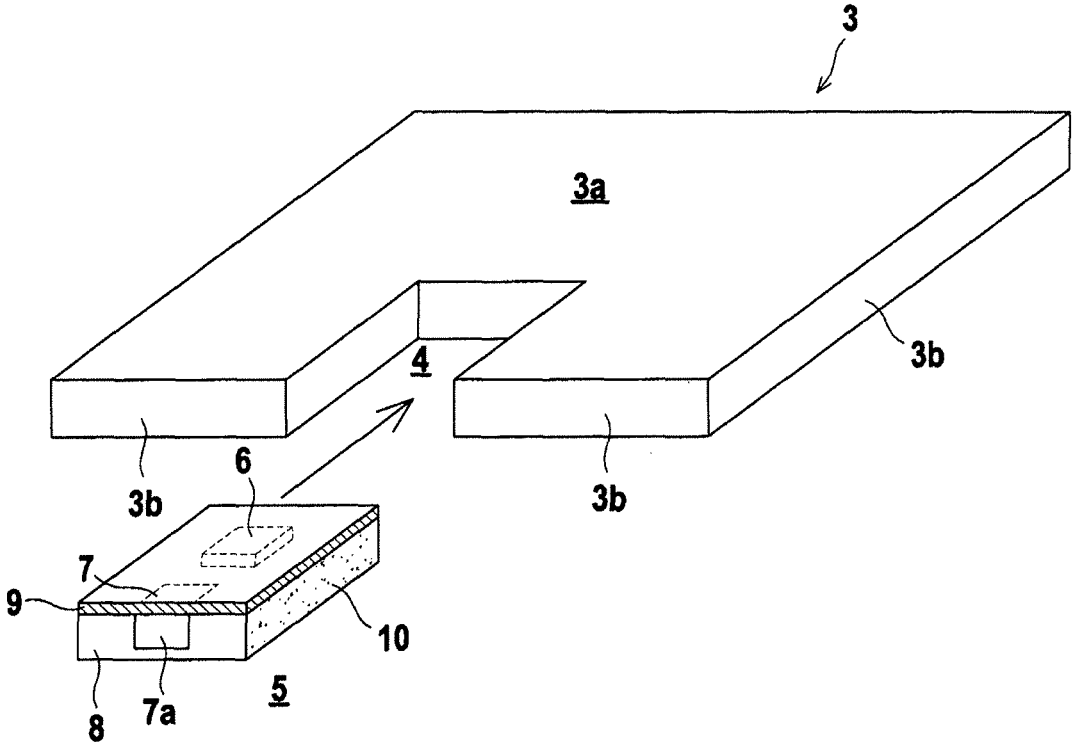
FIG. 2 is a perspective view of a body element for the photo book with an associated electronic unit used to implement the photo book according to an embodiment of the invention.

FIG. 2 shows a perspective representation of a body element 3 that forms the back of the cover 2 for the photo book 1. The body element 3 may comprise of a dimensionally stable material with flexural rigidity such as cardboard, paperboard or plastic. The body element 3 may have a rectangular contour with a flat top 3*a* and a flat bottom, as well as peripherally extending edges 3*b*. A through-passage 4 opens out along one edge 3*b* of the body element 3 and may have an essentially rectangular contour.

This through-passage 4 functions to accommodate an electronic unit 5, meaning a unit comprising the electronic components which can be integrated into the photo book 1. In the present case, an electronic memory element and a connection element may jointly form a structural unit according to an embodiment of the electronic unit 5.

The electronic memory element may be embodied as a memory chip 6. The connection element may take the form of a connector 7. Data, in particular image data such as photographs or films, can be stored non-volatile in the memory element. Data can be read into or read out of the memory chip 6 via the connector 7, which can be embodied in the form of a mini USB connector or a magnetically adhering connector 7. The initial data input occurs during the production process, using the software for producing the print template.

Figure 3:
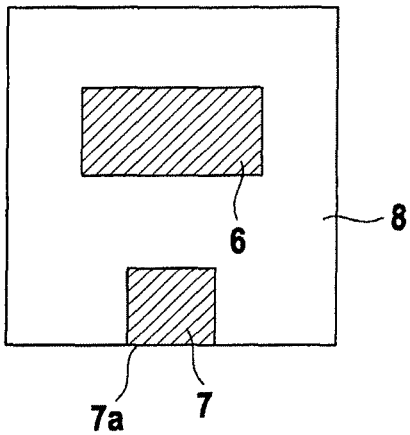
FIG. 3 is a cross-sectional view through the electronic component according to FIG. 2.

FIG. 3 shows that the connector 7 and the memory chip 6 may be arranged on a board 8. The board 8 may be coated on the top with a casting compound 9 which protects the memory chip 6 and the connector 7 against dirt and damage. The layer thickness of the casting compound 9 may furthermore be selected such that the structural height of the electronic unit 5 matches the thickness of the body element 3. The outside contour of the electronic unit 5 furthermore matches the edge contour of the through-passage 4, so that once the electronic unit 5 is installed in the through-passage 4, this unit is arranged form-fittingly inside the through-passage 4. To fixate the electronic unit 5 permanently in the through-passage 4, a layer 10 of an adhesive compound may be applied to the edges of the electronic unit 5 that is fitted into the through-passage 4. The electronic unit 5 positioned in this way forms a fixedly connected, stable unit together with the body element 3. The connector 7 comprises a contact surface 7*a* which is exposed along one peripheral edge 3*b* of the electronic unit 5. Following the installation of the electronic unit 5 in the through-passage 4, the contact surface 7*a* is exposed along one peripheral edge 3*b* of the body element 3.

The body element 3 of an alternative embodiment can be embodied as a plastic injection-molded part. In that case, the electronic unit 5 is placed as an insert part into a casting mold for producing the body element 3. The body element 3 is then produced by spraying molding compound around the insert part. The plastic material used to form the body element 3 is consequently sprayed directly onto the electronic unit 5 and is thus fixedly connected therewith.

Figure 4:
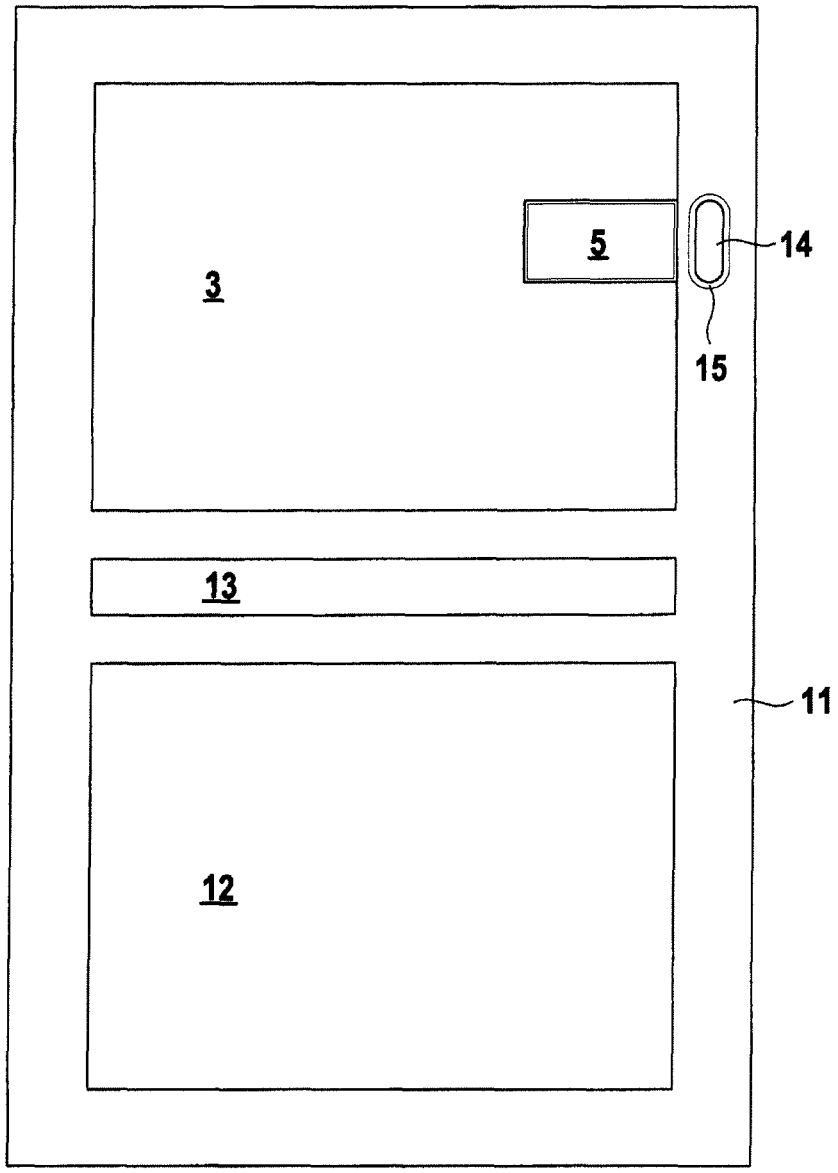
FIG. 4 is a view from above of the sheath for the photo book with thereon arranged body elements and provided with a hole or cutout worked into sheath used for implementing the photo book according to an embodiment of the invention.

FIG. 4 shows an arrangement of the components for embodying the cover 2.

In FIG. 4, a flexible sheath 11 is shown which is spread out flat. The sheath 11 is composed of a flexible material, for example paper. The sheath 11 can also consist of different types of materials, such as a plastic film, wherein these materials generally have a relatively low tearing strength. Once the photo book 1 is completed, the sheath 11 forms the outer sheath for the cover 2. The sheath 11 may have a rectangular shape.

Placed onto the inside, positioned on the top, of the sheath 11 are three body elements 3, 12 and 13 which may be secured on the sheath 11 with the aid of an adhesive or the like. The body element 3 with the electronic unit 5 integrated into its through-passage 4 forms a basic body which serves as the back side of the cover 2. Another body element 12 forms the front side of the cover 2. This body element 12 has an outside contour which corresponds to the body element 3. The narrow, third body element 13 forms the spine of the cover 2. The body elements 3, 12, 13 are composed of the same rigid, dimensionally stable material.

An opening 14, meaning a hole or cutout, is worked into the sheath 11 along the peripheral edge 3*b* of the electronic unit 5, at a short distance to the contact surface 7*a* of the connector 7, as shown in FIG. 4. The position and size of the opening 14 are adapted to the position and width of the contact surface 7*a* of the connector 7 in the electronic unit 5.

To avoid damages to the peripheral edge 3*b* that surrounds the opening 14 in the sheath 11, a reinforcing layer 15 may be applied to this edge 3*b*, as shown in FIG. 4. In principle, it is sufficient to apply a reinforcing layer 15 to the outside or the inside of the sheath 11. In the present case, a reinforcing layer 15 is applied to both the outside and the inside.

The reinforcing layer 15 may be composed of a tear-resistant material, in particular made of plastic. The reinforcing layer 15 may alternatively be embodied as an adhesive foil which can be attached to the peripheral edge 3*b* of the sheath 11 which delimits the opening 14, simply by fitting it on.

The dimensions of the reinforcing layer or of each reinforcing layer 15 are such that the layer completely encloses the opening 14.

Figure 5A:
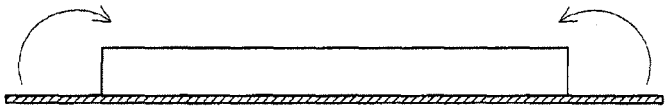
FIGS. 5*a*, 5*b* show a representation of steps for producing the cover of the photo book, according to the arrangement shown in FIG. 4.
Figure 5B:
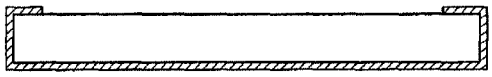

The cover 2 is completed so that the exposed edges of the sheath 11 are folded (FIG. 5*a*), are placed onto the exposed top sides 3*a* of the body elements 3, 12, 13 and are fixated by gluing them on (FIG. 5*b*).

Figure 6:
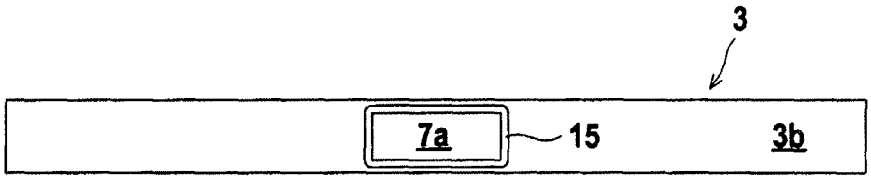
FIG. 6 is a view from above of one peripheral edge of the cover with a connection element that is exposed according to an embodiment of the invention.

To make possible the contacting between the contact surface 7*a* of the connector 7 that is integrated into the cover 2 and external contacting means, this contact surface is exposed in the cutout area, which is formed by the opening 14, as shown in FIG. 6.

The contact surface 7*a* is therefore completely surrounded by the reinforcing layer 15.

If the interface surface of an external connecting means is fitted onto the contact surface 7*a*, the reinforcing layer 15 protects the sheath 11 against a direct contact with the connecting means, meaning the sheath 11 is protected by the reinforcing layer 5 against wear and mechanical damage.

The invention claimed is:

1. A photo book, comprising:

a cover and one or more pages; and a structural unit including an electronic memory element and a connection element connected to the memory element, integrated into the cover;

wherein the cover comprises a body element and a flexible sheath surrounding the body element, the body element having a peripheral edge and a through passage that opens out along the peripheral edge of the body element, and wherein the structural unit is insertable into the through-passage and is fixated with adhesive agents along edges delimiting the through-passage of the body element so that the connection element opens out along a peripheral edge of the cover.

2. The photo book according to claim 1, wherein the flexible sheath includes an opening and a reinforcing layer delimiting the opening that forms a cutout for the connection element.

3. The photo book according to claim 1, wherein the structural unit is positioned form-fitting inside the through-passage.

4. The photo book according to claim 1, wherein the body element is composed of cardboard, paperboard or plastic.

5. The photo book according to claim 1, wherein the structural unit comprises a board on which the memory element, comprising a memory chip, is arranged, the memory chip communicating with the connection element.

6. The photo book according to claim 1, wherein the connection element comprises a connector.

7. The photo book according to claim 6, wherein the connector is a mini USB connector or a magnetically adhering connector.

8. The photo book according to claim 1, wherein the connection element is a wirelessly operating communication module.

9. A method for producing a photo book, the book including a cover and one or more pages with a therein integrated electronic memory element and thereto connected connection element, a flexible sheath and a body element, the method comprising:

producing the body element as a plastic injection-molded part in a casting mold with a structural unit constituting the integrated electronic memory and connection element connected thereto being surrounded with sprayed-on plastic, while in the mold, during a production of the body element; and joining and enclosing the body element with the flexible sheath so that a cutout is created for the connection element.

10. A method of producing a photo book that includes a cover and one or more pages; and a structural unit including an electronic memory element and a connection element connected to the memory element, integrated into the cover so that the connection element opens out along a peripheral edge of the cover, the method comprising:

arranging the memory element, comprising a memory chip communicating with the connection element on a board; and applying a casting compound to the board to form the structural unit.

11. A method for producing a photo book, the book including a cover and one or more pages with a therein integrated electronic memory element and thereto connected connection element, a flexible sheath and a body element, the method comprising:

inserting a structural unit comprising the electronic memory element and the connection element, into a through-passage of the body element that opens out along a peripheral edge of the body element so that the connection element is exposed along the edge of the body element and connecting the structural unit in the through-passage to the body element with the aid of adhesive agents; and joining and enclosing the body element with the flexible sheath so that a cutout is created for the connection element.

12. The method according to claim 11, including delimiting the cutout with a reinforcing layer worked into the flexible sheath which forms the cutout for the connection element following a complete encasing of the body elements with the flexible sheath.

13. The method according to claim 12, further including generating a print template, using a software program, for the photo book, reading data with the software program via the connection element into the electronic memory element, parallel to the generating of the print template, and storing the data in the electronic memory element.

14. A method for producing a photo book, the book including a cover and one or more pages with a therein integrated electronic memory element and thereto connected connection element, a flexible sheath and a body element, the method comprising:

placing the electronic memory element as an insert element in a casting mold to for producing a body element;

spraying a molding compound around and on the insert element in the casting mold to form the body element with the electronic memory element fixed in the body element and with a contact surface of the connection element exposed along a peripheral edge of the body element; and joining and enclosing the body element with the flexible sheath so that a cutout is created for the exposed surface of the connection element.

* * * * *